US006035050A

United States Patent [19]

Weinfurtner et al.

[11] Patent Number: 6,035,050

[45] Date of Patent: Mar. 7, 2000

[54] PROGRAMMABLE HEARING AID SYSTEM AND METHOD FOR DETERMINING OPTIMUM PARAMETER SETS IN A HEARING AID

[75] Inventors: Oliver Weinfurtner, Fishkill, N.Y.; Inga Holube, Erlangen, Germany

[73] Assignee: Siemens Audiologische Technik GmbH, Erlangen, Germany

[21] Appl. No.: 08/874,456

[22] Filed: Jun. 17, 1997

[30] Foreign Application Priority Data

Jun. 21, 1996 [EP] European Pat. Off. ..... 96110067

[51] Int. Cl.[7] ..... H04R 25/00

[52] U.S. Cl. ..... 381/313; 381/314

[58] Field of Search ..... 381/320, 321, 381/312, 314, 323

[56] References Cited

U.S. PATENT DOCUMENTS

| | | | |
|---|---|---|---|
| 3,989,904 | 11/1976 | Rohrer et al. | 179/107 FD |
| 4,259,547 | 3/1981 | Valley et al. . | |
| 4,425,481 | 1/1984 | Mansgold et al. | 179/107 FD |
| 4,947,432 | 8/1990 | T Pholm | 381/68.2 |
| 4,989,251 | 1/1991 | Mansgold | 381/315 |
| 5,202,927 | 4/1993 | T pholm . | |
| 5,303,306 | 4/1994 | Brillhart . | |
| 5,404,407 | 4/1995 | Weiss | 381/68 |
| 5,604,812 | 2/1997 | Meyer | 381/68.2 |
| 5,610,988 | 3/1997 | Miyahara | 381/68.4 |
| 5,710,820 | 1/1998 | Martin et al. | 381/68.4 |
| 5,721,783 | 2/1998 | Anderson | 381/68.6 |

FOREIGN PATENT DOCUMENTS

| | | |
|---|---|---|
| 0 712 263 | 11/1994 | European Pat. Off. . |
| OS 43 08 157 | 9/1994 | Germany . |
| OS 43 40 817 | 6/1995 | Germany . |

*Primary Examiner*—Curtis A. Kuntz
*Assistant Examiner*—Dionne N. Harvey
*Attorney, Agent, or Firm*—Hill & Simpson

[57] ABSTRACT

A hearing aid system with a hearing aid has a matching arrangement with a first memory for several parameter sets available for selection for each of several hearing situations, an input unit for selecting a current hearing situation and for selecting one of the several parameter sets available for this hearing situation, and a second memory for allocation data that identify the parameter sets selected for each hearing situation. For the determination of an optimal parameter set for each of several hearing situations, an optimal user-specific parameter set is allocated to each hearing situation as it arises during an optimization phase. After the optimization phase, the allocation data are evaluated for the determining an optimal parameter set for each hearing situation. This parameter set is then permanently programmed as the parameter set which will be called to set the transmission characteristics of the hearing aid whenever the hearing situation allocated thereto occurs.

15 Claims, 3 Drawing Sheets

PROGRAMMABLE HEARING AID SYSTEM AND METHOD FOR DETERMINING OPTIMUM PARAMETER SETS IN A HEARING AID

BACKGROUND OF THE INVENTION

1. Field of the Invention

The present invention is directed to programmable hearing aid system, as well as a method for determining optimum parameter sets in a hearing aid.

2. Description of the Prior Art

In a programmable hearing aid several parameter sets are generally stored so as to be selectable by the user. These parameter sets being known as hearing programs. Each of these parameter sets represents the settings, cooperatively matched to one another, of all signal processing parameters for a particular acoustic hearing or environmental situation (e.g. an environmental situation "quiet," i.e. without disturbing background noise, or an environmental situation with low-frequency disturbing noise, etc.). The wearer of the hearing aid can select the suitable hearing program.

A programmable hearing aid of this sort is known from Europearn Application 0 064 042. This hearing aid has a microphone, an earphone, a signal processor and a parameter memory. Up to eight parameter sets can be written into the memory by means of an external programming unit. By the actuation of a switch, the stored parameter sets are called one after the other and are supplied to the signal processor. The user can thus match the signal transmission function of the signal processor optimally to the current hearing situation.

In this known hearing aid system, the parameter set allocated to each hearing situation is determined during the adaptation of the hearing aid, i.e. by a hearing aid acoustician. It is difficult, however, to determine the optimal parameter set for different acoustic environmental situations of the hearing-impaired person in this manner, since the actual acoustic characteristic quantities thereof are finally dependent on individual data. For example, if a hearing aid wearer requires an "in the car" hearing program, because that person often travels in his or her own car, an optimal setting of the parameters for this program must be based on the acoustic characteristic quantities of that car, which in turn depend strongly on the type of car and other factors.

In order to avoid the complicated determination of a suitable parameter set by the hearing aid acoustician, in the hearing aid system disclosed in European Application 0 453 450 an external control apparatus is provided that calculates signal processing parameters to be set from audiometric data, in a complicated method, and calculates characteristic data from the environmental situation. This method is costly, however, and does not always produce an optimal parameter set.

An additional difficulty in the two above-cited methods for determining parameter sets is that even for identical hearing impairment (determined using a sound threshold audiogram), the subjective sensations of different hearing aid wearers can be different in identical acoustic environmental conditions, necessitating different optimal parameter sets for the respective wearers.

SUMMARY OF THE INVENTION

It is an object of the present invention to avoid the above problems associated with known hearing aids and hearing aid systems, and in particular to simplify, or often in practice to enable for the first time, the determination of parameter sets that are individually optimally matched to different hearing situations in a hearing aid.

The above object is achieved in accordance with the principles of the present invention in a hearing aid system having a programmable hearing aid with a signal transmission path therein including a signal processor which sets transmission characteristics in the signal path dependent on a stored parameter set. The parameter set is stored in a memory in the programmable hearing aid, and the system also includes matching means, having access to the memory in the hearing aid, for allocating respective parameter sets to different hearing situations. The memory means includes a first memory for storing a number of different parameter sets, input means for identifying a number of different hearing situations and for allowing a wearer of the hearing aid to select and allocate a parameter set for each hearing situation each time it occurs. In a training phase, the hearing situations may each arise at a number of different times, and each time the wearer of the hearing aid makes an allocation of a parameter set to the current hearing situation. These allocations, produced over time during the training phase, are stored in a second memory. A control and processing means evaluates the allocations in the second memory, such as based on their frequency, for assigning a parameter set to each hearing situation dependent on these allocations. For example, for each hearing situation, the control and processing means can identify the parameter set most frequently selected by the user as being appropriate for that hearing situation, and the control and processing means then permanently allocates that parameter set to that hearing situation in the parameter set memory in the programmable hearing aid. This configures the hearing aid so that, in the future, each time that hearing situation arises, the hearing aid will identify the hearing situation and select the allocated parameter set for use in setting the transmission characteristics as long as that hearing situation prevails.

Since the parameter set memory in the programmable hearing aid can be reprogrammed, i.e., the contents thereof can be altered, for example, if the users hearing impairment changes, the term "permanently stored" as used in the context of this parameter set memory means that the allocations of the respective parameter sets are stored in the parameter set memory so as to be unchanged unless and until a reprogramming takes place. The term "permanently stored", therefore, does not mean that the parameter set allocations are forever unalterable.

The above object is also achieved in a method for determining an optimal parameter set for controlling the transmission characteristics of a programmable hearing aid in each of a number of different hearing situations, wherein a user wearing the hearing aid, in a training phase, experiences a number of different hearing situations occurring at different times, and for each hearing situation, the wearer of the hearing aid selects one of a number of different trial parameter sets for use in that hearing situation, each time the hearing situation occurs. In this training phase, the allocations of the different trial parameter sets to the different hearing situations are stored, and after completion of the training phase, these allocations are evaluated to permanently assign one of the trial parameter sets to each hearing situation. The permanent assignment can be, for example, on the basis of the frequency during the training phase by which the hearing aid user selected a particular trial parameter for a particular hearing situation. In a configuration phase, the parameter set memory in the hearing aid is then configured (programmed) based on the evaluation of the allocations so as to permanently store one parameter set for each hearing situation. In the future operation of the hearing aid, when a particular hearing situation arises, the parameter set allocated thereto as being optimum when then be retrieved from the memory in the hearing aid, and used to set the transmission characteristics of the hearing aid, as long as that particular hearing situation prevails.

The programmable hearing aid can "identify" which of the different hearing situations is currently in existence either by the user identifying that hearing situation, such as by a switch or by a remote control, or the programmable hearing aid can include a trainable network, such as a neural structure, which can, over time, "learn" when a particular hearing situation is present. The identification of the current hearing situation is then undertaken fully automatically within the hearing aid itself, without any necessity of intervention by the hearing aid wearer.

The invention is based on the fundamental concept of not attempting to generate a predetermined parameter set allocated to each hearing situation of a programmable hearing aid during the adjustment by the hearing aid acoustician, but rather to make several trial parameter sets for each hearing situation available to the wearer at the time the wearer first uses the hearing aid. In an optimization phase, so that the hearing aid wearer can then determine which parameter set is individually best suited for him or her in various individual hearing situations. This parameter set is then finally fixedly allocated to that hearing situation.

An advantage of the inventive solution is that the matching of the hearing aid to the various hearing situations is better achieved with conventional procedures, since it is individually oriented according to the real acoustic environmental conditions of the personal life situations of the hearing-impaired person. Moreover, the matching can largely be carried out by the hearing aid wearer, so that it is less costly.

In different embodiments of the invention, summarized below, the main functions of the matching means are differently distributed to different modules.

In one embodiment at least the first memory for the trial parameter sets, the second memory for the allocations decided on by the user, and the control and processing unit are provided in an external control module that is connected wirelessly with a mobile auxiliary module. The latter contains a receiver that receives data from the control module and forwards it to the hearing aid.

In a second embodiment the modules identified in the first embodiment are contained in the mobile auxiliary module, while the external control module essentially contains only operational elements (i.e., input keys and a display), as well as one or several interfaces.

In a third embodiment, the modules can be grouped as in either the first or second embodiments but the auxiliary module is omitted, and its functions are permanently integrated into the hearing aid.

A fourth embodiment is constructed as described for the third embodiment, but after the termination of the matching phase, the control module serves as a normal remote control of the hearing aid. The matching functions are then deactivated.

In a fifth embodiment all modules of the matching means, including the operational elements, are integrated into the mobile auxiliary module, to be worn on the body. The control module can be omitted.

The evaluation of the allocation data stored in the second memory of the matching means during the matching phase preferably ensues either in an external evaluation computer or in the control module. Besides the evaluation, a constant monitoring of the allocation data also can take place only at the end of the matching phase, e.g. in order to determine whether no optimal trial parameter set is present for a hearing situation, and the hearing aid acoustician must thus be consulted to program new trial parameter sets. In an alternative embodiment, the matching means produces new parameter sets according to predetermined rules.

In a preferred embodiment, the hearing aid has a neural structure and a comparison and training circuit. The neural structure continuously evaluates acoustic input signals. The comparison and training circuit makes it possible to train the neural structure according to the parameter sets selected for each hearing situation during a training phase. After the conclusion of the training phase, the neural structure independently determines matching signal processing parameters from the input signals, so that the hearing aid user never again has to indicate the currently present hearing situation.

DESCRIPTION OF THE PREFERRED EMBODIMENT

Figure 1:
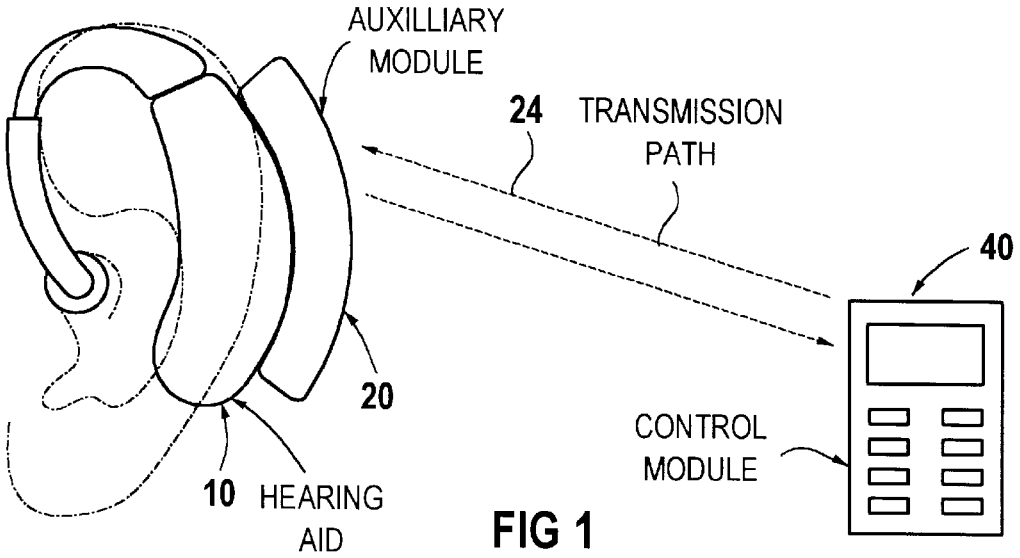
FIG. 1 illustrates the arrangement of the components of an inventive hearing aid system in an embodiment with a behind-the-ear hearing aid.

In FIG. 1, the outline of an ear is shown as a dotted line, with a hearing aid 10 to be worn behind the ear, on which an auxiliary module 20 is detachably plugged. The hearing aid 10 and the auxiliary module 20 are electrically connected with one another via contact surfaces. Via this connection, parameter sets can be programmed into the hearing aid 10, which sets determine the signal processing characteristic in the hearing aid 10. The auxiliary module 20 permits the exchange of data with an external control module 40 via a wireless data transmission path 24.

Figure 2:
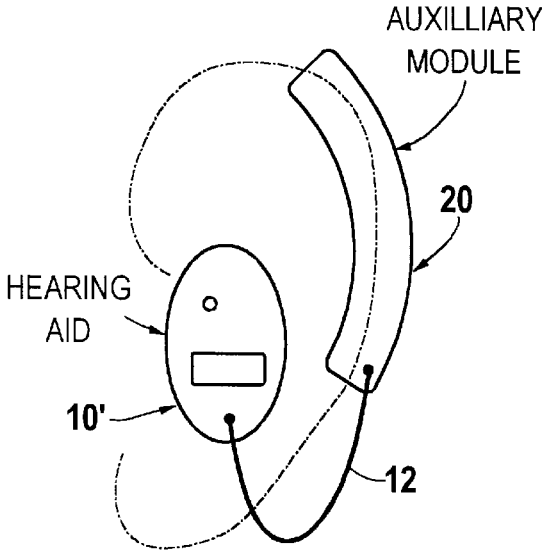
FIG. 2 illustrates the arrangement of the components of an inventive hearing aid system in an embodiment with an in-the-ear hearing aid.

As a modification of the hearing aid system shown in FIG. 1, FIG. 2 shows a hearing aid 10' to be worn in the ear that is connected with the auxiliary module 20, to be worn behind the ear, via a connection line 12. The connection line 12 is detachably connected to the hearing aid 10' by means of known connection elements (plugs/sockets, etc.), as are used, for example, for the hard-wired programming of hearing aids.

Figure 3:
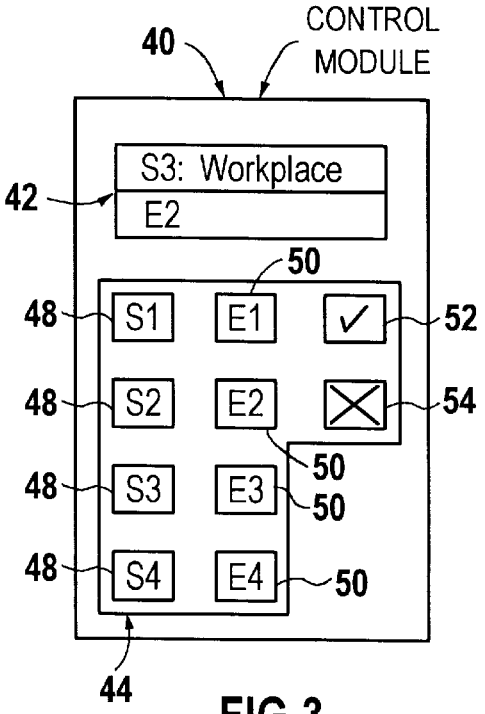
FIG. 3 shows a view of an external control module used in the inventive system and method.

FIG. 3 shows details of the operating and display elements of the external control module 40, constructed in a manner similar to a remote control for electronic entertainment systems. A display 42, constructed for example as an alphanumeric LCD display, serves for user control. For example, the set hearing situation can be displayed in a first line (such as hearing situation 53: workplace in the example of FIG. 3), and the respectively allocated parameter set can be displayed in a second line (such as parameter set E2 in the example). Other texts that were programmed in during the programming of the control module 40 can also be displayed. An input unit 44, constructed as a keyboard or keypad, has several keys or pads, in particular keys 48 for setting the hearing situation, keys 50 for the allocation of a parameter set to the hearing situation, a key 52 for confirmation and a key 54 for the correction of erroneous inputs. In order to organize the operation of the control module 40 simply, only a few clearly identified keys without double functions are provided; for example, keys for a maximum of four hearing situations, respectively with a maximum of four trial parameter sets, in the control module 40 shown in FIG. 3.

Figure 4:
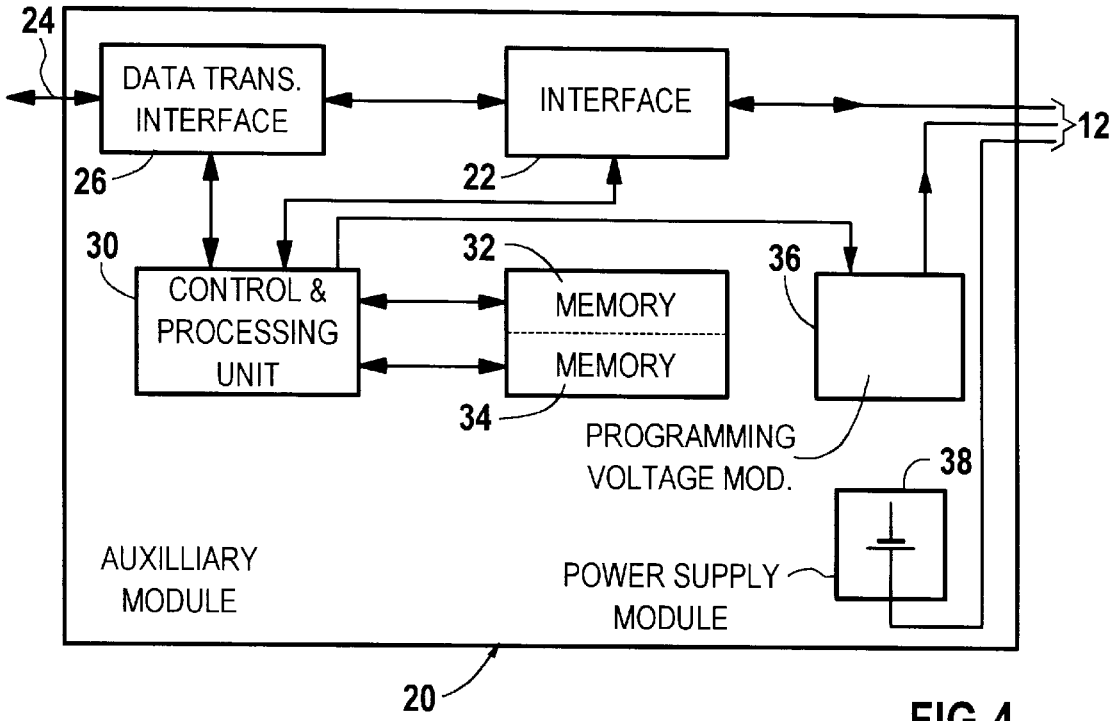
FIG. 4 shows a block diagram of an auxiliary module used in the inventive system and method.

The auxiliary module 20 shown in FIG. 4 has an interface 22 for bidirectional data transmission to the hearing aid 10 (or 10') via contacts or via the electrical connection line 12. A data transmission interface 26, formed by an infrared light-emitting diode and a photosensor, serves to provide the bidirectional data transmission path 24 to the external control module 40. The data transmission path 24 is preferably wireless. Visible or infrared light, radio-frequency broadcast waves, ultrasound, electrical induction, etc., can be employed. The interfaces 22 and/or 26 can also be constructed more simply as unidirectional interfaces that enable transmission of parameter sets only in the direction to the hearing aid 10 or 10'.

The interfaces 22 and 26 are connected with one another, as well as with a control and processing unit 30. The latter enables access to several read-only memories and/or write/read memories, in particular to a first memory 32 for the trial parameter sets and to a second memory 34 for the allocations chosen by the user during the optimization phase. In addition, a module 36 for the production of a possibly required programming voltage for the hearing aid 10 or 10', as well as a power supply module 38, are provided. The module 36 is connected to the connection line 12, and is controlled by the control and processing unit 30. The power supply module 38 supplies all the named components, and furthermore is connected with the hearing aid 10 or 10' via the connection line 12.

The auxiliary module 20 is shown in FIG. 4 in an embodiment with complete functionality. In other embodiments, in which some functions are for example, taken over by the control module 40, some modules can be omitted. For example, the first and second memories 32 and 34 need only be provided either in the auxiliary module 20 or in the control module 40. The control and processing unit 30 can then be constructed more simply, or even can be omitted entirely.

Figure 5:
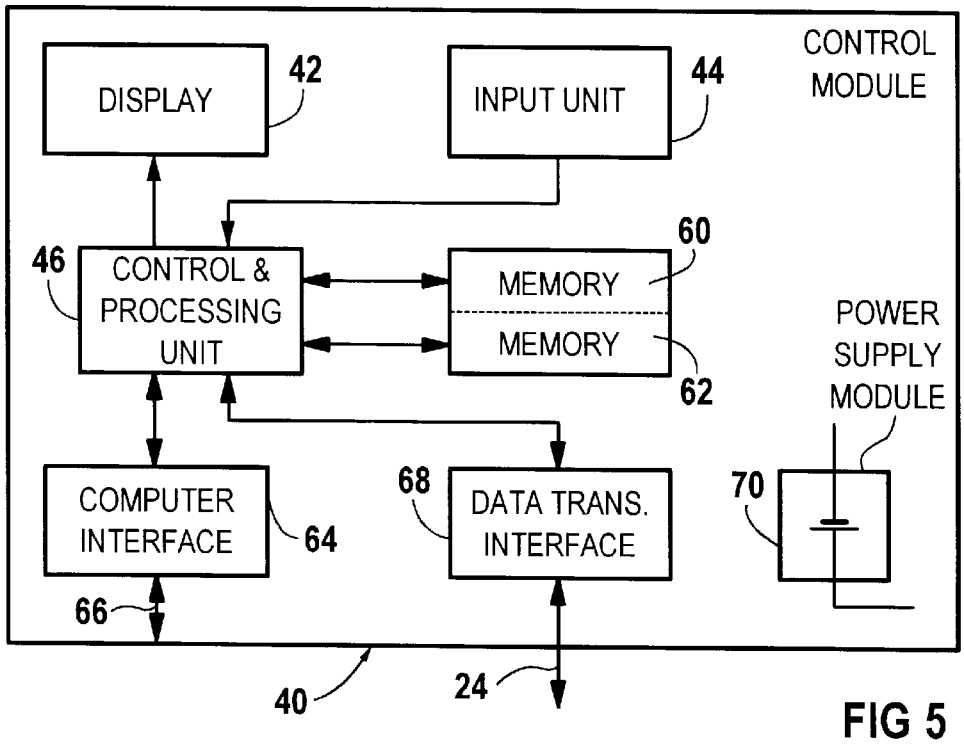
FIG. 5 shows a block diagram of the external control module used in the inventive system and method.

FIG. 5 shows the construction of the external control module 40. The display 42 and input unit 44, already described in connection with FIG. 3, are connected with a control and processing unit 46, to which are connected first and second memories 60 and 62, a computer interface 64 and a data transmission interface 68 to the auxiliary module 20. In addition, a power supply module 70 is provided for the named modules. The computer interface 64 is connected with a terminal 66 for an external evaluation computer. Via the computer interface 64, on the one hand trial parameter sets can be transmitted from the evaluation computer to the control module 40 before the beginning of the optimization phase, and, on the other hand, allocation data can be transmitted from the control module 40 to the evaluation computer after the termination of the optimization phase.

The control module 40 is also shown in FIG. 5 in an embodiment with complete functionality. According to the distribution of the functions of the matching means among the auxiliary module 20 and to the control module 40, individual modules can be omitted or can be simplified. The computer interface 64 can be omitted if the entry of the trial parameter sets ensues via the input unit 44, and the evaluation of the allocation data is carried out by the control and processing unit 46. Moreover, the control and processing unit 46 for generating new or modified trial parameter sets can be set up according to rules that are programmed in or that are fixedly predetermined.

Figure 6:
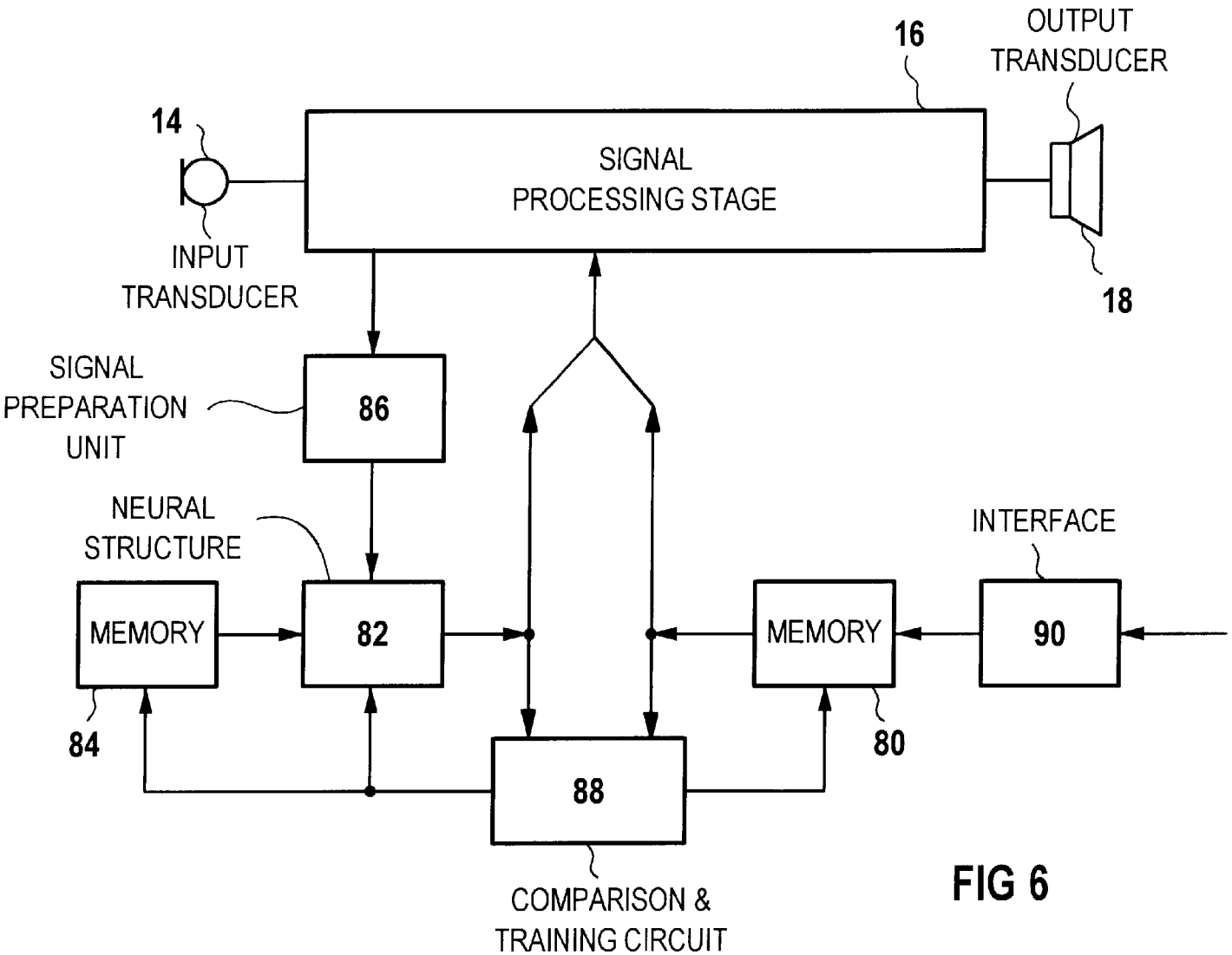
FIG. 6 shows a block diagram of a hearing aid with a neural structure used in the inventive system and method.

FIG. 6 shows the circuit of a complexly constructed hearing aid 10 or 10', specified in more detail below. For the previously described embodiments of the hearing aid system, a hearing aid 10 or 10' is sufficient, in which, of the components shown in FIG. 6, there are provided only an input transducer 14 constructed as a microphone, an output transducer 18 constructed as an earphone, a signal processing stage 16 with a transmission characteristic determined by the aforementioned parameters of a parameter set, a memory 80 for at least one parameter set of the signal processing stage 16, and an interface 90 to the matching means. In an embodiment, the interface 90 is connected with the auxiliary module 20 via the electrical connection line 12.

For the configuring and optimization of the parameters of the hearing aid, according to an exemplary embodiment of the inventive method the hearing aid acoustician first determines the hearing situations for which the wearer of the hearing aid wishes to individually determine the parameter sets (also called hearing programs). Examples of hearing situations might include: "at work," "conversing in the car," "listening to music at home," etc. For each of these hearing situations, several trial parameter sets are determined, dependent on the hearing impairment of the wearer of the hearing aid using matching software that runs on the external evaluation computer. The determined parameter sets are transmitted to the control module 40 via the computer interface 64, and are either stored there in the first memory 60 or are transmitted further via the data transmission path 24 to the auxiliary module 20, and are stored in the first memory 32 thereof.

For the parameter optimization phase, the control module 40 and the mobile auxiliary module 20 are provided to the hearing-impaired person. If the hearingimpaired person is in a hearing situation typical for him or her, he or she can first select the hearing situation via the control module by means of the keys 48, and can subsequently respectively activate one of the trial parameter sets allocated thereto by means of the keys 50. This set is now transmitted from the control module 40 to the mobile auxiliary module 20, is programmed into the hearing aid 10 or 10' by this module, and is activated there. If the hearing-impaired person has found the optimal set of parameters for the selected hearing situation, he or she can store it by actuating the confirmation key 52. That is, it is noted in the second memory 62 of the control module 40 (in the second memory 34 of the auxiliary module 20) that an allocation of this parameter set to the identified hearing situation has taken place.

After the user's optimization phase is completed, the second memory 62 of the control module 40 (the second memory 34 of the auxiliary module 20) is read out by the hearing aid acoustician, and it is determined the frequency with which allocation of hearing situations to parameter sets has been made. The parameter set with the most frequent allocation for a particular hearing situation is stored as the corresponding hearing program in the hearing aid 10 or 10' for that hearing situation. This is done for each hearing situation.

The optimization phase is terminated, and it remains only for the user to wear the hearing aid 10 or 10' (and no longer the matching means including the auxiliary module 20 and the control module 40). If the hearing aid system is designed so that the control module 40 communicates directly with the hearing aid 10 or 10', the control module 40 can then also serve as a normal remote control of the hearing aid 10 or 10' after the end of the optimization phase. The matching functions are then deactivated. In this version, the parameter sets determined in the optimization phase can remain stored in the control module 40, which now acts as a remote control. Only the currently desired parameter set needs to be transmitted to the hearing aid 10 or 10', so that the latter need have only a memory 80 for a single parameter set.

If, upon completion of the user's optimization phase the allocation frequency of some or all of the parameter sets is too low to allow the acoustician to confidently assign significance for a hearing situation, the corresponding parameter sets can be modified by the acoustician using the matching software, and can be stored again in the control module 40. The optimal allocation can then be determined again in a second optimization phase.

In an alternative embodiment of the inventive method, the evaluation of the allocations of hearing situations to trial parameter sets ensues already during the optimization phase in the control module 40. A too low frequency of the allocations of trial parameters to a particular hearing situation is interpreted to mean that no optimal parameter set is present for this hearing situation. The wearer of the hearing aid is then requested via the display 42 to consult his or her hearing aid acoustician, in order to have new trial parameter sets programmed in. Alternatively, these new trial parameter sets can be generated in the control module 40 according to fixedly predetermined rules or rules that can be programmed in.

In another variant embodiment of the invention, the hearing aid 10 or 10' is constructed according to FIG. 6. Besides the components already specified above, this hearing aid 10 or 10' has a neural structure 82, also called a neural network, a memory 84 for parameters of the neural structure 82, a signal preparation unit 86 and a comparison and training circuit 88. The signal preparation unit 86 is connected with the signal processing stage 16 at a suitable top point, and supplies suitably prepared signals to the neural structure 82, which correspond to the items of acoustic information received by the input transducer 14.

The memory 84 contains parameters that control the output behavior of the neural structure 82. The memory 84 is connected with the neural structure 82, as well as with the comparison and training circuit 88. The comparison and training circuit 88 controls the neural structure 82, the memory 84 for the neural structure 82 and the memory 80 for parameter sets. The outputs of the memory 80 or of the neural structure 82 are connected with the comparison and training circuit 88, as well as with a parameter input of the signal processing stage 16, via which the transmission characteristic of the signal processing stage 16 can be set. By means of the comparison and training circuit 88, it is determined among other things whether the outputs of the neural structure 82, the parameters stored in the memory 80 or a mixture of the two are used to control the signal processing stage 16.

From European Application 0 712 263, a hearing aid 10 or 10' is known in which the parameters controlling the signal processing are determined by a neural structure. The content of European Application 0 712 263 is incorporated herein by reference, in particular with respect to the construction of the signal preparation unit 86 (see FIG. 3 of European Application 0 712 263, with the associated specification) and the neural structure 82 (see FIG. 4 to FIG. 8 of European Application 0 712 263, with the associated specification). European Application 0 712 263 does not, however, describe how the training of the neural structure 82 can take place.

According to the inventive system and method, trial parameter sets are first determined for the training of the neural structure 82, and thus for the programming of the hearing aid system. During the optimization phase, the user first communicates the parameter set believed to be optimal for the momentary hearing situation to the hearing aid 10 or 10', via the interface 90 in the way specified above. This is written into the memory 80. Independently of this, the neural structure 82 calculates a proposed parameter set from the data originating from the signal preparation unit 86.

During the optimization phase, the comparison and training circuit 88 continuously compares the parameter set believed to be optimal by the user and written into the memory 80, with the parameter set determined by the neural structure 82. An error identifier is obtained from the deviations of these parameter sets according to a predetermined algorithm (e.g. a learning algorithm for neural networks according to the prior art). Based on this error identifier, the comparison and training circuit modifies the parameters, contained in the memory 84, for the neural structure 82. In this way, the neural structure 82 is trained during the optimization phase until it can by itself determine suitable parameter sets for each environmental acoustic condition, as it arises, with satisfactory precision.

At the beginning of the optimization phase (training phase), the signal processing stage 16 receives its control parameters exclusively from the memory 80 for the parameter set entered by the user; as the training success progresses, these parameters are increasingly taken from the neural structure 82. After the termination of the training phase, the signal processing stage 16 continues to receive its control parameters only from the neural structure 82. The matching means is then no longer needed by the hearing aid wearer.

Although the present invention has been described with reference to a specific embodiment, those of skill in the art will recognize that changes may be made thereto without departing from the scope and spirit of the invention as set forth in the appended claims.

We claim as our invention:

1. A hearing aid system comprising:

a programmable hearing aid having a housing adapted to be worn at an ear, said housing containing an input transducer and an output transducer with a signal path therebetween, signal processing means connected in said signal path for influencing a signal in said signal path dependent on a parameter set, and a parameter set memory accessible by said signal processor means for storing at least one parameter set for use by said signal processing means;

identifier means in said housing for identifying a current hearing situation defining an environment in which said programmable hearing aid is disposed;

matching means for allocating respective parameter sets in a plurality of parameter sets to different hearing situations, said matching means including a first memory for storing said plurality of parameter sets, input means for identifying a current hearing situation among a succession of hearing situations and for allowing a wearer of said hearing aid to select and allocate a parameter set, for said plurality of parameter sets, for each hearing situation each time it occurs, a second memory for storing respective allocations made by said user among said parameter sets and said hearing situations, and control and processing means for evaluating said allocations in said second memory for assigning a parameter set among said plurality of parameter sets to each hearing situation dependent on said allocations and for programming said parameter set memory with said parameter sets respectively allocated to said hearing situations, said parameter set memory then supplying to said hearing situations, said parameter set memory then supplying to said signal processing means, when a current hearing situation is identified by said identifier means, the parameter set allocated to the current hearing situation; and said matching means comprising an external control module. including at least said input means, and an auxiliary module, said auxiliary module containing a remainder of said matching means not contained in said external control module, and means for wirelessly transmitting data at least from said external control module to said auxiliary module, said auxiliary module being temporarily mechanically connectable to said housing and adapted to be worn at an ear together with said housing during a matching procedure, consisting of a training phase and a hearing aid configuration phase, in which said respective parameter sets in said plurality of parameter sets are allocated to different hearing situations and being electrically connected to said signal processing means, and after said matching procedure said auxiliary module being removable from said housing.

2. A hearing aid system as claimed in claim 1 wherein said auxiliary module contains an interface to said programmable hearing aid and a data transmission interface to said external control module, and wherein said external control module contains, in addition to said input means, said first and second memories, said control and processing means, and a data transmission interface to said auxiliary module.

3. A hearing aid system as claimed in claim 1 wherein said auxiliary module contains an interface to said hearing aid, said first and second memories, said control and processing means, and a data transmission interface to said external control module, and wherein said external control module, in addition to said input means, contains a data transmission interface to said auxiliary module.

4. A hearing aid system as claimed in claim 1 further comprising a remote control means for operating said programmable hearing aid, including said identifier means, said remote control means containing said external control module.

5. A hearing aid system as claimed in claim 1 wherein said matching means comprises an external control module, including at least said input means, and an auxiliary module contained in said programmable hearing aid, said auxiliary module containing a remainder of said matching means not contained in said external control module, and means for wirelessly transmitting data at least from said external control module to said auxiliary module.

6. A hearing aid system as claimed in claim 5 wherein said auxiliary module contains an interface to said programmable hearing aid and a data transmission interface to said external control module, and wherein said external control module contains, in addition to said input means, said first and second memories, said control and processing means, and a data transmission interface to said auxiliary module.

7. A hearing aid system as claimed in claim 5 wherein said auxiliary module contains an interface to said hearing aid, said first and second memories, said control and processing means, and a data transmission interface to said external control module, and wherein said external control module, in addition to said input means, contains a data transmission interface to said auxiliary module.

8. A hearing aid system as claimed in claim 5 further comprising a remote control means for operating said programmable hearing aid, including said identifier means, said remote control means containing said external control module.

9. A hearing aid system as claimed in claim 1 wherein said matching means includes display means for displaying an alphanumeric indication of said parameter sets and said different hearing situations.

10. A hearing aid system as claimed in claim 1 further comprising means for determining an optimal allocation of each parameter set to each hearing situation from said allocations stored in said second memory.

11. A hearing aid system as claimed in claim 10 wherein said means for determining an optimal allocation includes means for determining whether an optimal allocation of a respective parameter set to each hearing situation can be determined from said allocations stored in said second memory.

12. A hearing aid system as claimed in claim 1 further comprising a neural structure, a neural structure memory for storing parameters for said neural structure, and comparison and training means for training said neural structure according to said parameter sets respectively allocated to said hearing situations, by modifying said parameters in said neural structure memory.

13. A method for determining an optimal parameter set for controlling transmission characteristics of a programmable hearing, aid having a housing containing a signal processor, in each of a plurality of different hearing situations, comprising the steps of:

temporarily mechanically connecting an auxiliary module to said housing and temporarily electrically connecting said auxiliary module to said signal processor: providing a remote control in a wireless communication with said auxiliary module;

in a training phase, wearing said hearing aid and said auxiliary module by a user in said plurality of different hearing situations;

in said training phase, making a plurality of different trial parameter sets from said auxiliary module available for selection by said user in each hearing situation each time a hearing situation each time a hearing situation occurs;

in said training phase, for each hearing situation, said user selecting one of said trial parameter sets deemed optimal by said user and storing an allocation in said auxiliary module of said one of said trial parameter sets to the hearing situation for which it was deemed optimal;

in a hearing aid configuration phase, evaluating all of the stored allocations of said trial parameter sets to the different hearing situations and remotely programming said hearing aid via said auxiliary module, using said remote control to assign one trial parameter set in said hearing aid to each hearing situation for controlling said transmission characteristics of said hearing aid when said hearing situations respectively occur; and removing said auxiliary module from said housing.

14. A method as claimed in claim 13 wherein the step of evaluating all of said stored allocations comprises evaluating a frequency for which said user selected each trial parameter set for each hearing situation.

15. A method as claimed in claim 13 comprising the additional step of identifying an allocation frequency of a parameter set to a hearing situation which is too low to be significant, and providing a message to said user of said hearing aid to select a different trial parameter set.

* * * * *